US007750583B2

(12) United States Patent
Fischer et al.

(10) Patent No.: US 7,750,583 B2
(45) Date of Patent: Jul. 6, 2010

(54) ELECTRONIC REACTIVE CURRENT OSCILLATION-REDUCING BALLAST

(75) Inventors: Klaus Fischer, Friedberg (DE); Josef Kreittmayr, Bobingen (DE)

(73) Assignee: OSRAM Gesellschaft mit beschraenkter Haftung, Munich (DE)

( * ) Notice: Subject to any disclaimer, the term of this patent is extended or adjusted under 35 U.S.C. 154(b) by 361 days.

(21) Appl. No.: 11/919,009

(22) PCT Filed: Mar. 22, 2006

(86) PCT No.: PCT/DE2006/000509

§ 371 (c)(1),
(2), (4) Date: Oct. 22, 2007

(87) PCT Pub. No.: WO2006/111122

PCT Pub. Date: Oct. 26, 2006

(65) Prior Publication Data

US 2009/0206774 A1 Aug. 20, 2009

(30) Foreign Application Priority Data

Apr. 22, 2005 (DE) ..... 10 2005 018 792

(51) Int. Cl.
*H05B 37/02* (2006.01)

(52) U.S. Cl. ..... 315/291; 315/224; 315/360; 315/DIG. 4

(58) Field of Classification Search ..... 315/209 R, 315/227 R, 224–226, 246–247, 291, 299, 315/307, 360, DIG. 4, DIG. 7
See application file for complete search history.

(56) References Cited

U.S. PATENT DOCUMENTS

| | | | | |
|---|---|---|---|---|
| 6,020,689 | A * | 2/2000 | Gradzki et al. | 315/224 |
| 6,043,611 | A | 3/2000 | Gradzki et al. | |
| 6,229,271 | B1 * | 5/2001 | Liu | 315/291 |
| 7,132,802 | B2 * | 11/2006 | Fischer et al. | 315/224 |
| RE40,843 | E * | 7/2009 | Ribarich | 315/307 |
| 2002/0153849 | A1 * | 10/2002 | Ribarich | 315/247 |
| 2003/0080696 | A1 * | 5/2003 | Tang et al. | 315/291 |

FOREIGN PATENT DOCUMENTS

| | | |
|---|---|---|
| EP | 1 465 330 | 10/2004 |

* cited by examiner

*Primary Examiner*—Thuy Vinh Tran

(57) ABSTRACT

The invention relates to an electronic ballast presenting an input capacitor and comprising and step-up chopper for operating a load, for example a discharge lamp, on a phase control dimmer having an integrated or parasite inductance. In such a way, the voltage overshooting on the input capacitor are reduced by active charge or discharge thereof.

20 Claims, 7 Drawing Sheets

ELECTRONIC REACTIVE CURRENT OSCILLATION-REDUCING BALLAST

TECHNICAL FIELD

The present invention relates to an electronic ballast, which has an input capacitance, with a step-up converter for operating a discharge lamp, for example a low-pressure discharge lamp, using a phase gating dimmer, which has an incorporated or parasitic inductance.

PRIOR ART

Electronic ballasts for operating discharge lamps are known in various embodiments. In general, they contain a rectifier circuit for rectifying an AC voltage supply and charging a capacitor, which is often referred to as an intermediate circuit capacitor. The DC voltage present at this capacitor is used for supplying an inverter, which operates the discharge lamp. In principle, an inverter produces a supply voltage for the lamp to be operated with a high-frequency current from a rectified AC voltage supply or a DC voltage supply. Similar devices are also known for other lamp types, for example in the form of electronic transformers for halogen lamps.

Step-up converter circuits can be used for system current harmonic reduction of discharge lamps. Step-up converters have a storage inductor, a switching element, a diode and an intermediate circuit capacitor. The intermediate circuit capacitor supplies, for example, a low-pressure discharge lamp via an inverter circuit.

Such a step-up converter functions as follows: the AC system voltage is converted in a rectifier into a pulsating DC voltage. The storage inductor and the diode are connected between the supply potential of this pulsating DC voltage and the intermediate circuit capacitor. In the switched-on state, the switching element ensures an increasing current flow in the storage inductor up to a value which can be set, the switch-off current threshold. Once the switching element has switched off, the diode conducts the current injected into the storage inductor into the intermediate circuit capacitor.

The use of a step-up converter in a ballast for a discharge lamp is described in EP 1 465 330 A2. An application claiming priority from this European application was filed in the US and published as US 2004/0207337, and granted as U.S. Pat. No. 7,132,802, which is incorporated herein by reference in its entirety.

Phase gating dimmers for power control are likewise known. Phase gating dimmers provide a periodic system supply to the load. In each half period, the system supply is only supplied to the load after a time which can be set, however.

Phase gating dimmers often contain, as a switching element which controls the current flow from a supply system to a load, a triac. With such a switching element it is possible to allow for a current flow from the system to the load after a time which can be set within a system half-cycle. A voltage is made available at the output of the phase gating dimmer which, in a first time interval, is zero, namely during phase gating, and, in a second time interval, substantially corresponds to the input voltage of the dimmer.

In order to avoid radio interference, many phase gating dimmers contain an inductance connected in series with the switching element. In addition, even if no corresponding component is installed in the dimmer, a parasitic inductance can occur between the phase gating dimmer and the capacitive load, for example caused by line inductances. Any reference to an "inductance in the phase gating dimmer" will be understood in this sense in the text which follows.

DESCRIPTION OF THE INVENTION

The invention is based on the technical problem of specifying an electronic ballast which is improved in terms of its operational response for dimmable discharge lamps.

The invention relates to an electronic ballast with a step-up converter, which has an input capacitance, for operation using a phase gating dimmer, which has an inductance acting in series with the supply, characterized in that the electronic ballast has a device for storing a prognosis value of the supply voltage of the electronic ballast, in which, during a system half-cycle of the supply, the prognosis value of the supply voltage is stored after termination of the phase gating in order to adjust the input capacitance, prior to the end of the phase gating, at most to a voltage which corresponds to the value stored in the device, by means of a charging operation in a subsequent system half-cycle.

Preferred configurations of the invention are specified in the dependent claims and will be explained in more detail below. The disclosure in this case always relates both to the method category and the device category of the invention.

Electronic ballasts for operating discharge lamps often have an effective input capacitance. The invention is based on the consideration that the effective input capacitance of the electronic ballast together with the inductance acting in series with the supply of the phase gating dimmer forms a resonant circuit, and an overshoot of the voltage across the input capacitance can occur. Such voltage oscillations can impair the operational response of electronic ballasts for discharge lamps during operation using a phase gating dimmer.

Specifically, after the phase gating the switching element in the phase gating dimmer is brought into a conductive state; thereupon the input capacitance of the ballast is charged to the instantaneous value of the supply voltage. This charging of the input capacitance takes place via the inductance of the phase gating dimmer, which determines the rise in the current. The voltage across the input capacitance first reaches the instantaneous value of the supply voltage, but then goes beyond it. This takes place because the inductance in the phase gating dimmer is now demagnetized and a current flow in the original flow direction is maintained. If the inductance in the phase gating dimmer is demagnetized and the voltage across the input capacitance is greater than the supply voltage applied, no system current flows through the ballast until the overvoltage at the input capacitor has dissipated owing to discharge.

The triacs which are often used as a switching element in phase gating dimmers require a certain holding current, i.e. if they are brought into a conductive state, a minimum current is required for maintaining the conductance. If this current is not present, the triac is turned off again. If, for a short period of time, there is no system current flowing through the phase gating dimmer, it may be that the triac changes over from the conductive to the off state. The above-described reactive current oscillations can cause such system current interruptions.

The voltage overshoots are particularly pronounced if the voltage across the input capacitance after the phase gating is markedly lower than the instantaneous value of the supply voltage. Here and in the text which follows, the "instantaneous value of the supply voltage after the phase gating" is understood to mean that the supply voltage across the ballast has already built up to its full extent after the phase gating.

If the voltage across the input capacitance at this time is greater than the instantaneous value of the supply voltage, no current flows through the dimmer until the input capacitance has been charged by a current through the load to such an extent that its voltage corresponds to the instantaneous value of the supply voltage. At this time, however, the switching element in the phase gating dimmer can switch off.

During operation, the two cases are therefore to be avoided.

The greater the difference between the supply voltage of the ballast and the voltage across the input capacitance of the ballast at the end of the phase gating, the greater the voltage drop across the inductance of the dimmer. The current flowing during magnetization of the inductance of the dimmer increases as long as the voltage across the input capacitance is lower than the supply voltage at the load.

A reduction in this difference at the beginning of the magnetization of the inductance in the dimmer reduces the initial voltage across said inductance. Corresponding reactive currents, which magnetize the inductance and cause the voltage overshoot across the input capacitance, are therefore reduced.

For this purpose, the input capacitance is charged to a value which at most corresponds to the instantaneous value of the supply voltage at the end of the phase gating by means of a charging operation (charging or discharging operation) prior to the end of the phase gating of a system half-cycle. The voltage across the input capacitance should at this point not exceed the value of the supply voltage, however, since otherwise no continuous system current can be guaranteed.

The instantaneous value of the supply voltage at the end of the phase gating within a system half-cycle is not known in advance. The invention therefore has a storage device for storing a prognosis value for the supply voltage at the time of the end of the phase gating, which prognosis value was obtained from one or more preceding system half-cycles. Preferred implementations of such a storage device will be proposed further below. The prognosis value of the instantaneous value of the supply voltage at the end of the phase gating can then be used in a subsequent system half-cycle to actively charge or discharge the input capacitance in such a way that the voltage across the input capacitance at most assumes the stored value.

Preferably, the invention provides a device for storing an instantaneous value of the supply voltage at the end of the phase gating from one or more preceding system half-cycles. The instantaneous value of the supply voltage at the end of the phase gating of a preceding system half-cycle does not need to be identical with the instantaneous value of the supply voltage at the end of the phase gating of a subsequent system half-cycle, however; instead what is involved is a prognosis for the supply voltage value, as explained in the preceding paragraph.

If the system half-cycle in which a value has been stored is not yet behind by too many system half-cycles, it can be assumed that the stored value for the present system half-cycle is very similar. This is the case because changes in the phase gating between successive system half-cycles generally take place slowly.

Reactive current oscillations are reduced most effectively if the input capacitance is charged precisely to the value of the supply voltage at the end of the phase gating. However, in order to be sure that the voltage across the input capacitance is no greater than the supply voltage at the end of the phase gating, the input capacitance is charged to a value which is slightly less than the stored prognosis value.

In practice, it has proven successful to set the voltage across the input capacitance to approximately 90-95% of the supply voltage at the end of the phase gating. However, even values above 50% can also be worked with.

In a preferred embodiment of the invention, the prognosis value of the supply voltage after the phase gating in each system half-cycle is stored afresh and used in the respective subsequent system half-cycle.

Preferably, the storage device stores the prognosis value of the supply voltage within a time window after termination of the phase gating. In a preferred embodiment of the invention, a peak value detection circuit is used for this purpose. The time window can be used, for example, for charging a capacitor, but is very short in comparison with the period duration of the sinusoidal supply voltage.

The time window is preferably set in such a way that it opens and closes within a time interval which begins with the connection of the phase gating dimmer and which ends with the voltage across the input capacitance reaching the value of the instantaneous supply voltage. This in particular rules out the case in which a value is stored which is greater than the supply voltage when the dimmer is connected.

When the supply voltage is first applied to the dimmer and the lamp, a reactive current oscillation cannot be ruled out since as yet no prognosis value has been stored. After a few half-cycles, however, a stable state is reached.

In a preferred embodiment of the invention, the length of the time window is determined by a monoflop. This is set by a signal from a control circuit of the electronic ballast and is reset again after a given time. For example, the beginning current flow through the storage inductor of the step-up converter can trigger the setting of the monoflop. The monoflop defines the time window for the storage of the instantaneous value of the supply voltage at the end of the phase gating, for example by means of a switch controlled by the monoflop.

In a further preferred embodiment, the time window is predetermined by means of a differentiator comprising a capacitor and a resistor. The differentiator is addressed by an edge of a signal from a control circuit of the ballast. As a result of the edge, a voltage jump followed by an exponential decay occurs across the resistor of the differentiator. The time constant of the exponential decay is determined by the size of the resistor and of the capacitor in the differentiator. The exponential decay defines the time window for storing the instantaneous value of the supply voltage.

A further preferred embodiment for determining a time window and for storing a prognosis value of the supply voltage at the end of the phase gating is based on the following relationship: at the time of the end of the magnetization of the inductance in the dimmer, the instantaneous value of the voltage across the input capacitance corresponds to the instantaneous value of the supply voltage. Since the supply voltage has barely changed since the end of the phase gating, the voltage across the input capacitance approximately corresponds to the instantaneous value of the supply voltage at the end of the phase gating. The time of the end of the magnetization of the inductance in the dimmer corresponds to the zero crossing of the second derivative of the voltage across the input capacitance of the ballast and can be determined easily (as described in the exemplary embodiments in connection with FIG. 10). In this case, the voltage across the input capacitance of the ballast at this time can be stored as the prognosis value.

Preferably, an embodiment of the invention has a comparison device. This compares the value from the storage device with the present value of the voltage across the input capacitance. Prior to the end of the phase gating, the comparison device drives the control circuit of the step-up converter, which then correspondingly discharges the input capacitance. If, for example, the voltage across the input capacitance is greater than the stored value, the input capacitance is discharged. The exemplary embodiment describes more specifically how the output signal of the comparison device can contribute to the control of the charging operation of the input capacitance.

Preferably, the input capacitance is discharged via an activation of the step-up converter prior to the termination of the phase gating.

Preferably, the input capacitance is charged by the intermediate circuit capacitor. For this purpose, a diode, which is connected between the supply potential-side terminals of the intermediate circuit capacitor and the input capacitance, can be bridged by a resistor. There are designs of step-up converters which have a plurality of diodes connected between the supply potential-side terminals of the intermediate circuit capacitor and the input capacitance; in this case one or more diodes can be bridged.

In order to charge the input capacitance to the value stored in the storage device, a controller is required. If such a controller is not specially added, first the input capacitance can be charged by the intermediate circuit capacitor so severely that the voltage across the input capacitance is in each case too high. Thereupon, the step-up converter can be activated in order to discharge the input capacitance to the desired value (at most the prognosis value).

Up until this point it has been described how reactive current oscillations can be reduced by suitable charging or discharging of the input capacitance prior to the end of the phase gating. As an additional measure according to the invention, reactive current oscillations can be reduced by suitably setting the time profile of the current through the step-up converter, whereby in addition the current charging the inductance in the phase gating dimmer can be reduced quantitatively. A ballast which implements both possibilities of reactive current reduction damps reactive current oscillations even more effectively.

In order to additionally reduce the reactive current oscillations, during the demagnetization of the inductance in the phase gating dimmer a temporarily increased current, in comparison with the operation of the step-up converter after the demagnetization of the inductance in the dimmer, is passed through the step-up converter, i.e. within a time interval defined by the demagnetization. The word "during" is to be understood throughout the present text in this sense. This current discharges the input capacitance and the voltage across said input capacitance is reduced again to the level of the instantaneous value of the supply voltage. This current discharging the input capacitance needs to be sufficiently high to diminish the excessively high voltage across the input capacitance before the inductance in the phase gating dimmer is completely demagnetized.

A step-up converter can be operated in various operating modes, primarily a distinction being drawn between discontinuous operation and continuous operation. Often, step-up converters are operated continuously in the discontinuous mode. That is to say that the switching element in the step-converter is only switched on if the storage inductor of the step-up converter has completely demagnetized and there is no longer any current flowing through it. Switching losses are minimal in this operating mode.

If, when switching on the switching element in the step-up converter, it is not waited until the storage inductor has completely demagnetized, this is referred to as continuous operation. The switching element is therefore switched on when a threshold for the current through the storage inductor—the switch-on current threshold—is undershot. This switch-on current threshold may be at different levels and can assume a different value in each cycle of the step-up converter.

In a preferred embodiment, the step-up converter during the demagnetization of the inductance in the phase gating dimmer is operated at temporarily increased switch-on current thresholds, in comparison with the operation of the step-up converter after the demagnetization of the inductance in the phase gating dimmer. As a result, the current flow through the step-up converter in this time period can be significantly increased. Although this measure causes the switching losses in the step-up converter to increase temporarily, these losses are not great when averaged over the system half-cycle.

In the simplest case, this may mean that, during the demagnetization of the inductance in the phase gating dimmer, the step-up converter functions with continuous operation and, after this time period, changes over to discontinuous operation immediately or with a delay.

However, the above embodiment in particular also includes the case in which, after the demagnetization of the inductance in the phase gating dimmer, there is no changeover to the discontinuous operation of the step-up converter, but continuous operation is maintained with lower switch-on current thresholds of the switching element in the step-up converter.

In a further preferred embodiment, in particular in combination with the above measures, the switch-off current threshold of the switching element of the step-up converter is increased during the demagnetization of the inductance of the phase gating dimmer. As an alternative or in addition to the continuous operation, this measure can also result in a considerable increase in the current flow through the step-up converter.

Preferably, during the magnetization of the inductance in the phase gating dimmer, the current flowing through the step-up converter is reduced or even suppressed. This preferably takes place by the switching element of the step-up converter being permanently turned off during the magnetization of the inductance. Therefore no current discharging the input capacitance can flow. As a result, the magnetization of the inductance in the phase gating dimmer and therefore the energy stored in it can be reduced to a minimum. The less energy is stored in the inductance of the phase gating dimmer, the less pronounced is the excessively high voltage across the input capacitance.

In another preferred embodiment of the present aspect of the invention, the current flowing through the step-up converter during the magnetization of the inductance in the phase gating dimmer is reduced by virtue of the fact that the switch-off current threshold of the step-up converter is selected to be low in comparison with the operation of the step-up converter after magnetization of the inductance in the dimmer. As a result, the step-up converter draws a current having a lower amplitude; the mean current flowing through the inductance of the phase gating dimmer can thus be set to be very low, or even vanishingly low.

A preferred embodiment has a circuit arrangement for detecting, by means of measurement technology, the termination of the phase gating, the beginning of the demagnetization of the inductance in the phase gating dimmer and the termination of the demagnetization of the same inductance. These three times determine the two relevant time intervals within which embodiments of the invention work towards a reduction in the excessively high voltage across the input capacitance. Between the termination of the phase gating and the time at which the voltage across the input capacitance reaches the instantaneous value of the supply voltage, the inductance in the phase gating dimmer is magnetized; from this point on, it is demagnetized.

The circuit arrangement preferably comprises a series circuit comprising two differentiators, which can be, for example, connected in parallel with the input capacitance. The output voltage of the second differentiator corresponds to the second derivative of the voltage across the input capacitance and has the property that, during the magnetization of the inductance in the phase gating dimmer, it has a different mathematical sign than during the demagnetization of the same inductance. Therefore, the two relevant time intervals are determined and the output signal of the second differentiator can be used for the purpose of setting the operational parameters of the step-up converter.

Generally, a high-frequency, comparatively low AC voltage is superimposed on the voltage across the input capacitance by the step-up converter function. These high-frequency oscillations are output by the first differentiator; a second differentiation may not produce a sensible result. A preferred embodiment of the invention therefore provides a peak value detection circuit. The first derivative of the voltage across the input capacitance is smoothed by means of the peak value detection. The quality of a subsequent differentiation is therefore increased.

Preferably, when an operating mode of the step-up converter with an increased switch-on current threshold of the switching element in the step-up converter is used—during the demagnetization of the inductance in the phase gating dimmer—the transition to the subsequent operation with lower switch-on current thresholds is carried out slowly. This means that the switch-on current thresholds of the switching element in the step-up converter, distributed over a few current consumption cycles of the step-up converter, become lower. As a result, further load current oscillations can be reduced.

BRIEF DESCRIPTION OF THE DRAWINGS

The invention will be explained in more detail below with reference to exemplary embodiments. The individual features disclosed in the process can also be essential to the invention in other combinations. The description above and below relates to the device category and the method category of the invention without this explicitly being mentioned in detail.

PREFERRED EMBODIMENT OF THE INVENTION

Figure 1:
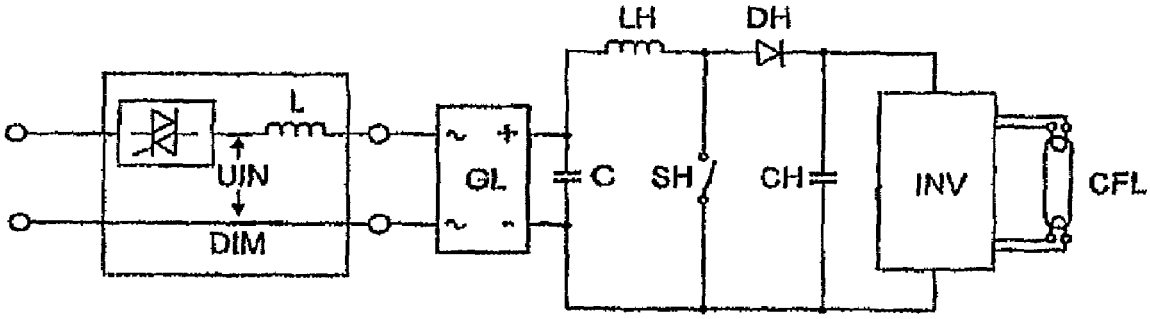
FIG. 1 shows, schematically, a step-up converter as part of an electronic ballast with a phase gating dimmer connected upstream.

FIG. 1 shows, schematically, a step-up converter as part of an electronic ballast of a compact fluorescent lamp CFL with a phase gating dimmer connected upstream.

The step-up converter is formed by a capacitor C, an intermediate circuit capacitor CH, a diode DH, a storage inductor LH and a switching element SH, in this case a MOSFET.

In general, step-up converters also contain a control circuit (not shown here, however) for driving the switching element SH. For example, a control circuit as described in EP 1 465 330 A2 can be used.

The electronic ballast contains a rectifier GL, via which the intermediate circuit capacitor CH is charged via the storage inductor LH and the diode DH. The intermediate circuit capacitor supplies, for example, a compact fluorescent lamp CFL via an inverter circuit INV.

The circuit functions as follows: the AC system voltage is converted in the rectifier GL into a pulsating DC voltage. The capacitor C for radio interference suppression is connected in parallel with the rectifier GL on the DC voltage side. A storage inductor LH is connected into the positive feedline. The switching element SH, in the switched-on state, ensures a current flow in the storage inductor LH which increases up to a value which can be set. After the switching element SH has been switched off, the diode DH conducts the current impressed in the storage inductor LH into the intermediate circuit capacitor CH.

It will first be described how reactive current oscillations can be reduced by means of adjusting the time profile of a current ILH through the step-up converter.

Figure 2:
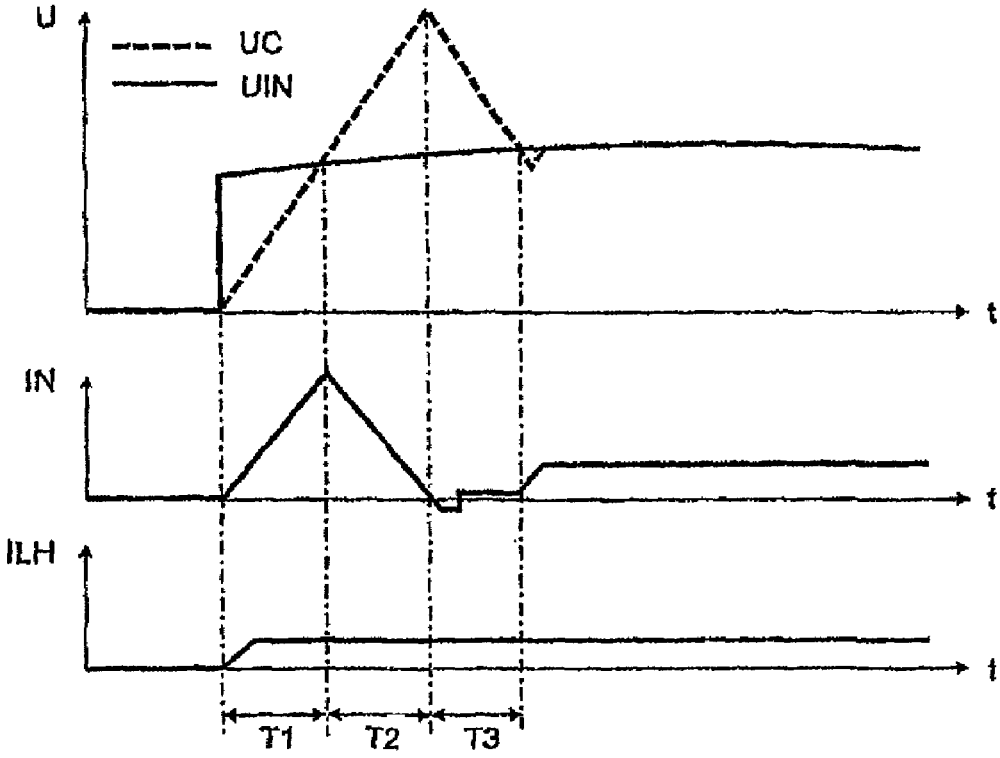
FIG 2 (PRIOR ART)
FIG. 2 shows, schematically, for an electronic ballast according to the prior art, the supply voltage UIN, the voltage across an input capacitance of a load UC, the system current IN and the current ILH flowing through the step-up converter. Three relevant time intervals T1, T2, T3 are plotted.

FIG. 2 shows, for an electronic ballast in accordance with the prior art, the supply voltage UIN, the voltage across the input capacitance of the load UC, the system current IN and the mean current ILH flowing through the step-up converter. Three relevant intervals T1, T2, T3 are plotted.

The end of the phase gating defines the start of the first interval T1. A current flow IN from the supply system through the dimmer begins. The rise in the current IN is determined by the inductance of the dimmer. The voltage UC across the input capacitance C increases. The interval T1 ends as soon as the voltage UC across the input capacitance C corresponds to the instantaneous value of the supply voltage UIN.

In the second interval T2, the input capacitance C is charged again by the series inductance L of the phase gating dimmer. The complete demagnetization of the inductance L defines the end of the interval T2. Although in the time interval T2 the voltage across the input capacitance C is higher than the supply voltage UIN, a system current IN continues to flow because the inductance in the phase gating dimmer demagnetizes and maintains the flow of IN in the same direction.

In a third interval T3, first a low current IN flows from the input capacitance C back to the supply, since the rectifier diodes commutate in the reverse direction. Owing to the current ILH flowing through the step-up converter, the voltage across the input capacitance C is reduced and thereupon reaches the instantaneous value of the supply voltage. This time corresponds to the end of the interval T3.

In the scenario described above, in interval T3 the situation arises in which no system current IN is flowing. The consequence is that the phase gating dimmer, if it uses a triac as the switching element, is switched off. Triacs require a certain holding current in order to remain switched on.

Initially (FIGS. 3 to 6), measures supplementing the invention for reactive current reduction will be proposed. These are illustrated separately for better understanding. These measures interact with the invention explained with reference to FIGS. 7 to 11 and improve the reactive current oscillation reduction.

Figure 3:
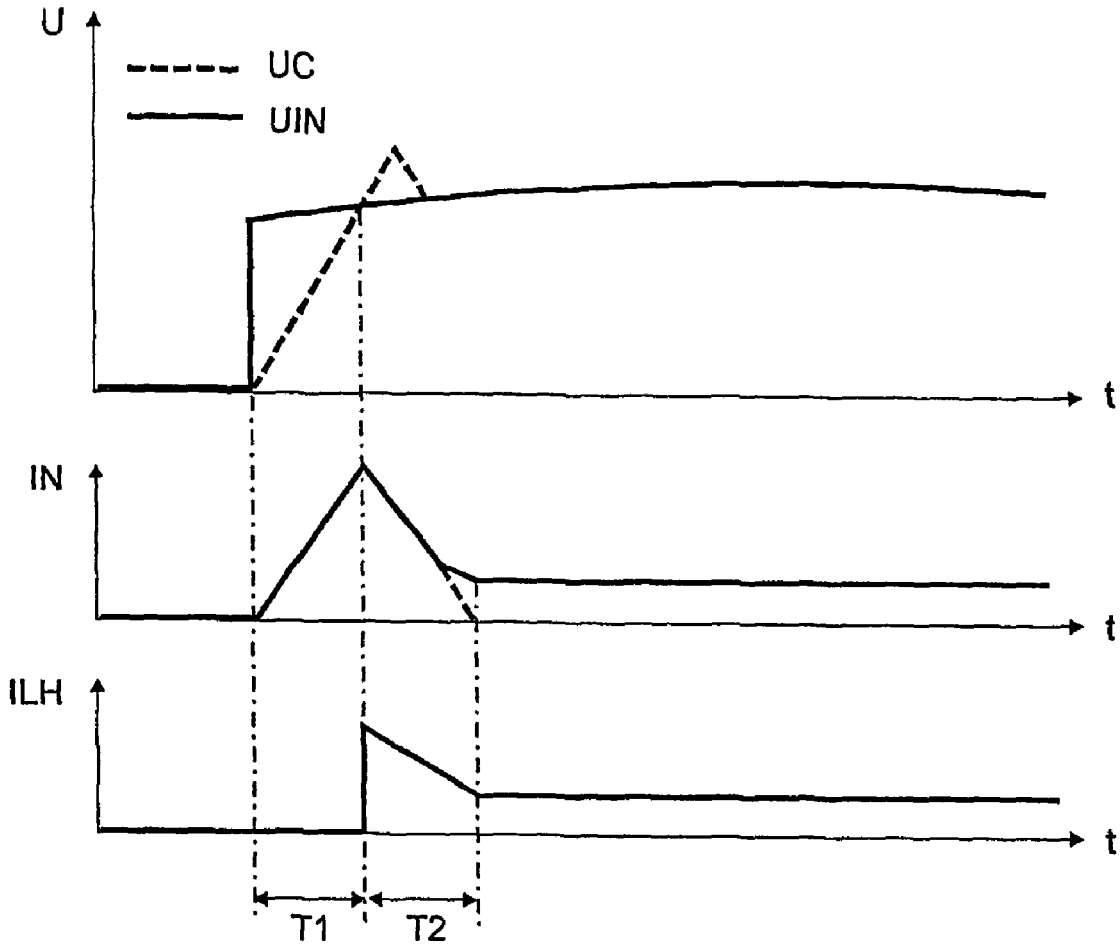
FIG. 3 shows, schematically, for an electronic ballast with a first device for reactive current oscillation reduction, the supply voltage UIN, the voltage across the input capacitance of the load UC, the system current IN and the mean current ILH flowing through the step-up converter. Two relevant time intervals T1, T2 are plotted.

FIG. 3 shows, for an electronic ballast with a controller for the current ILH through the step-up converter for reactive current oscillation reduction, the supply voltage UIN, the voltage UC across the input capacitance C of the load, the system current IN and the mean current ILH flowing through the step-up converter. Two relevant intervals T1, T2 are plotted.

In contrast to the scenario in FIG. 2, in the electronic ballast in FIG. 3 there is no current ILH flowing through the step-up converter during the interval T1 because the switching element SH of the step-up converter shown in FIG. 1 is permanently turned off. As a result, the magnetization of the series inductance L of the phase gating dimmer can be minimized.

In the interval T2, during which the inductance in the phase gating dimmer L is demagnetized and the energy stored in it is transferred to the capacitive load, a current ILH is flowing through the step-up converter. This current ILH needs to be so great that the temporary excessively high voltage across the input capacitance C is not as severely pronounced as in FIG. 2. For this purpose, the energy transferred from ILH needs to be greater within the interval T2 than the energy stored in the series inductance of the phase gating dimmer L at the beginning of the interval T2.

An increased current flow within the interval T2 can be achieved by virtue of the fact that the step-up converter, in contrast to the otherwise used discontinuous operating mode, is operated temporarily in the continuous operating mode.

By comparing FIG. 2 and FIG. 3 it can be seen that the current ILH through the step-up converter is severely reduced in the interval T1 and is severely increased in the interval T2, in accordance with the invention. After T2, the current flow from the supply IN is not interrupted in accordance with the invention. The interval T3 is dispensed with. The phase gating dimmer does not switch off.

In addition, the above result can also be achieved by an increase in the switch-off current threshold. If the step-up converter functions with an increased switch-off current threshold, a higher mean current flows through the storage inductor during the current consumption cycles. In order that the storage inductor is not saturated, it may need to be given different dimensions.

Figure 4:
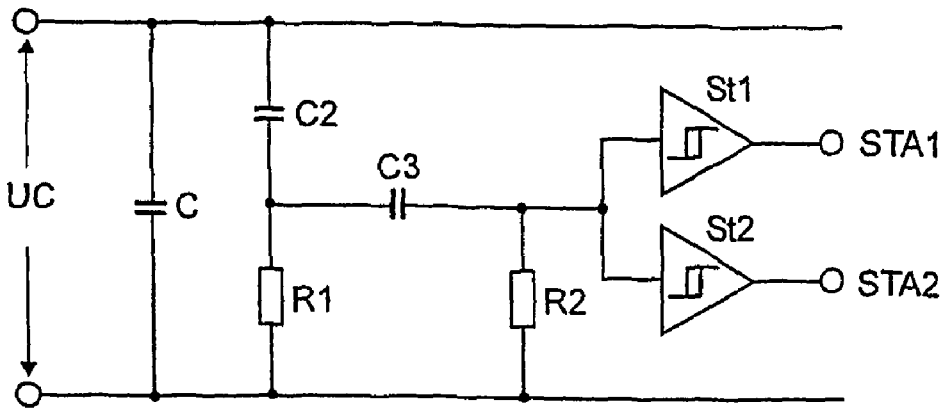
FIG. 4 shows a first circuit arrangement for reactive current oscillation reduction corresponding to FIG. 3.

FIG. 4 shows a circuit arrangement for detecting the limits of the intervals T1 and T2.

A series circuit comprising a capacitor C2 and a resistor R1 is connected in parallel with the input capacitance C of the load. A series circuit comprising a capacitor C3 and a resistor R2 is connected in parallel with the resistor R1. Threshold value components, specifically two Schmitt triggers ST1 and ST2, are connected to the connecting node between R2 and C3, the outputs of said threshold value components marking the intervals T1 and T2.

Figure 5:
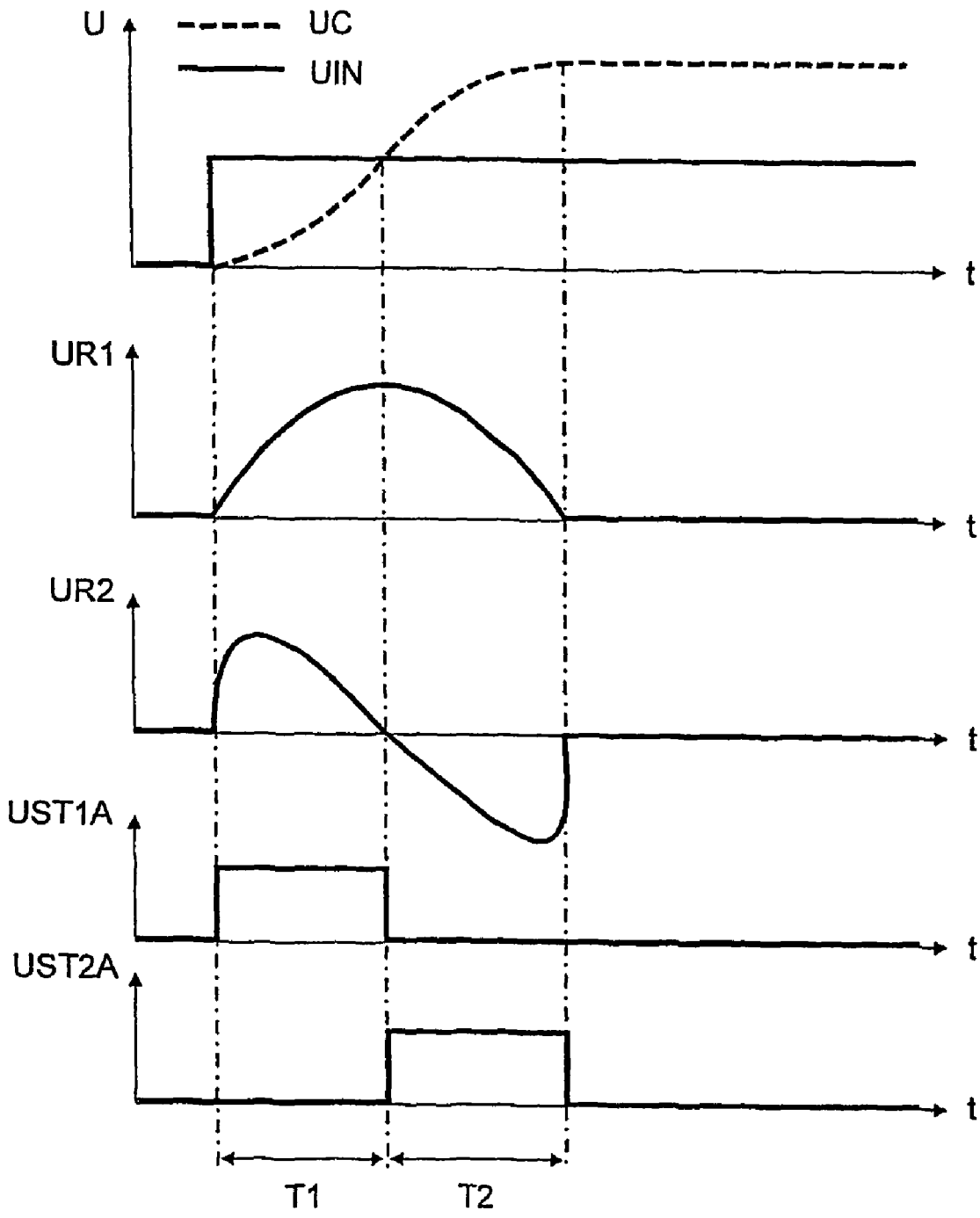
FIG. 5 shows relevant voltage profiles of the circuit arrangement shown in FIG. 4.

FIG. 5 shows relevant voltage profiles of the circuit arrangement from FIG. 4.

In order to describe the voltage profiles in FIG. 5, a jump function is assumed as the supply voltage UIN. This assumption as to the supply voltage UIN is a good approximation of the actual time profile of the phase-gated supply voltage on the time scale of interest. Furthermore, in the following consideration the current ILH through the step-up converter is omitted. This current is only of subordinate importance when considering the oscillation operations when the phase gating dimmer is switched on.

FIG. 5 shows, in the uppermost graph, the profile of the supply voltage UIN and of the voltage UC across the capacitive input load. As a deviation from FIGS. 2, 3, 7 and 9, the voltage UC is not illustrated schematically as a linear function but is illustrated somewhat more realistically.

The voltage UR1 across R1 is proportional to the current charging the input capacitance C. R1 and C2 are dimensioned in such a way that UR1 corresponds to the first derivative of the time profile of UC. In the second differentiating series circuit comprising R2 and C3, the latter are dimensioned such that a voltage drops across the resistor R2 which corresponds to the second derivative of the time profile of the voltage UC.

In order to determine the first derivative, it is alternatively also possible for the resistor R1 to be connected in series with the input capacitance C and for the capacitor C2 to be dispensed with.

The voltage drop across R2, which corresponds to the second derivative of the voltage UC present at the input capacitance C, is supplied to two Schmitt triggers. A first Schmitt trigger ST1 produces an output voltage USTA1, which in the interval T1 assumes a positive value. During the interval T1, the second derivative of UC is positive. Outside of T1, USTA1 corresponds to the reference potential. A second Schmitt trigger ST2 produces an output voltage USTA2, which, in the interval T2, assumes a positive value. During the interval T2, the second derivative of UC is negative. Outside of T2, USTA2 corresponds to the reference potential.

High-frequency AC voltages can be superimposed on the voltage UC across the input capacitance. The differentiation by the series circuit comprising the capacitor C2 and the resistor R1 primarily outputs the high-frequency AC voltage components. It may then no longer be possible for the voltage UR1 to be evaluated sensibly by the following differentiator.

Figure 6:
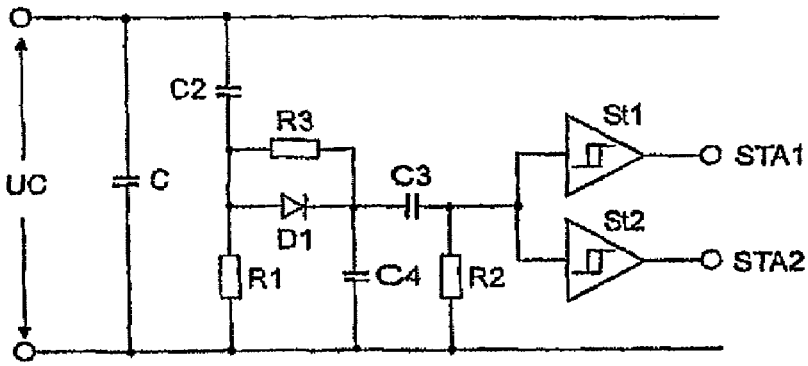
FIG. 6 shows a second circuit arrangement for reactive current oscillation reduction corresponding to FIG. 3.

FIG. 6 shows a correspondingly improved circuit arrangement. The capacitor C3 of the second differentiator is no longer connected directly at the connecting node of R1 and C2, but via a parallel circuit comprising a diode D1 and a resistor R3. The diode is polarized in such a way that a current can flow through it from C2 to C3, but no current can flow from C3 to C2. In addition, a further capacitor C4 is used which is connected in parallel with the series circuit comprising C3 and R2. The first derivative of the voltage across the input capacitance UC is smoothed by this peak value detection circuit. In the capacitor C4, the peak value of the voltage across R1 is input via the diode D1. Slow discharge of C4 is possible via R3.

The circuit arrangements described in FIGS. 4 and 6 can advantageously be used with the electronic ballast from EP 1 465 330 A2 by them being connected there in parallel with the input capacitance C (C1 in EP 1 465 330 A2). The circuit arrangements control the step-up converter in such a way that, in the interval T1, the current through LH and therefore the current discharging the input capacitance is minimal. This can be achieved by virtue of the fact that the switch SH is permanently turned off, to be precise by means of a control of the switch SH via the control device of the step-up converter from EP 1 465 330 A2 by the voltage signal STA1 from one of the circuit arrangements according to the invention.

In the interval T2, on the other hand, a temporarily increased mean current ILH is intended to flow through the step-up converter. For this purpose, the way in which the step-up converter operates can be varied via the control device from EP 1 465 330 A2 (in EP 1 465 330 A2, the control circuit is denoted by BCC).

Normally, the step-up converter is operated in the so-called discontinuous mode. The switch SH is always only switched on when there is no longer any current flowing in the storage inductor of the step-up converter, i.e. when the storage inductor LH has just been completely demagnetized. Switching losses are minimal in this operating mode.

In this exemplary embodiment, the step-up converter is operated in the continuous mode in the interval T2, however. The continuous mode is characterized by the fact that, for the switching-on of the switching element SH, there is not so long a wait as in the discontinuous case, i.e. a current flows continuously through the storage inductor LH. As a result, the mean current flow through the step-up converter in the interval T2 is increased in comparison with normal operation. Since the interval T2 is short in comparison with an entire system half-cycle, the increased switching losses caused average out to form a small, negligible variable.

It has been shown that a fluid transition from the continuous mode to the discontinuous mode is advantageous because, as a result, further current oscillations can be reduced. "Fluid transition" in this case means that the switch-on current thresholds are decreased. As soon as the switch-off time of the switch SH is so long that the storage inductor LH can completely demagnetize, a discontinuous mode is present. The switch-off time can, if desired, be extended further.

Figure 7:
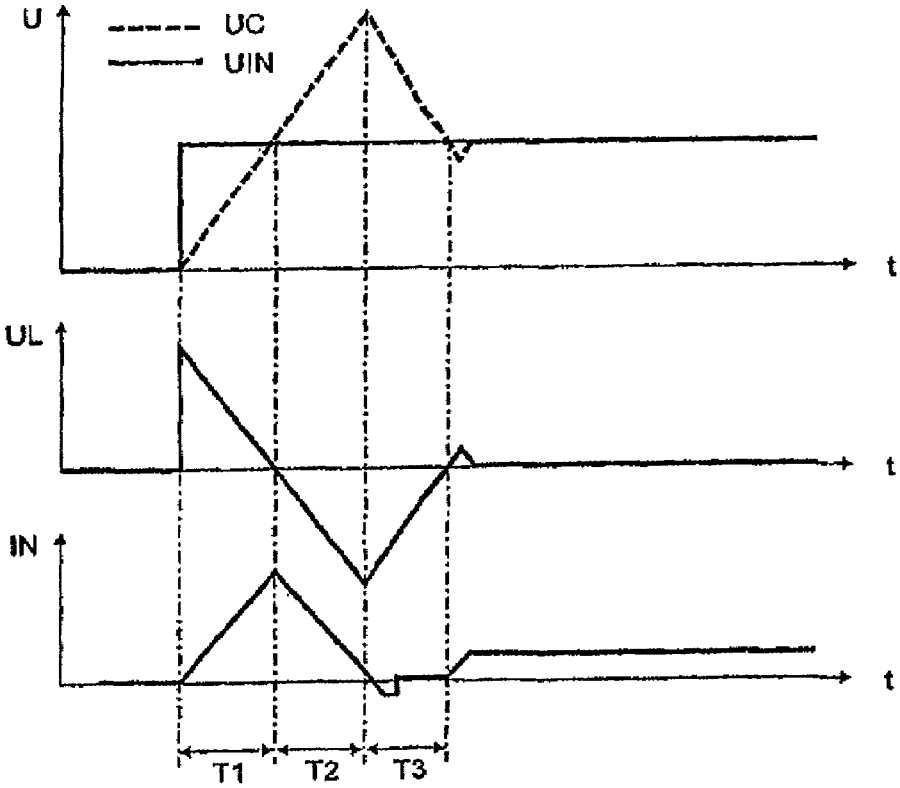
FIG 7 (PRIOR ART)
FIG. 7 shows, schematically, for an electronic ballast in accordance with the prior art, the supply voltage UIN, the voltage UC across an input capacitance C of the load, the voltage UL across an inductance of the dimmer and the system current IN. Three relevant time intervals T1, T2, T3 are plotted.

With reference to FIG. 7 of the text which follows will explain how reactive current oscillations can be reduced by suitably charging or discharging the input capacitance during the phase gating. Together with the previously described measures for reactive current oscillation reduction (according to FIGS. 4 and 6), the reactive current oscillations are damped more effectively than in the case of an isolated use. The input capacitance C is charged or discharged to a suitable value prior to the end of the phase gating, and the excessively high voltage UC is therefore already decayed or at least reduced after the end of the magnetization of the inductance in the dimmer. A remaining reactive current oscillation can be further damped by appropriate control of the current through the step-up converter. Even if all of these measures interact with one another, they are illustrated separately for better understanding.

FIG. 7 shows, as does FIG. 2, firstly for understanding purposes for an electronic ballast in accordance with the prior art, the supply voltage UIN, the voltage UC across the input capacitance C of the load and the system current IN. In addition, the figure shows the voltage UL across the inductance in the phase gating dimmer. The same three intervals T1, T2, T3 as in FIG. 2 are plotted.

The profile of the supply voltage UIN, the voltage across the input capacitance UC and the profile of the system current in the time intervals T1, T2 and T3 is identical to that in FIG. 2.

The rise in the current IN is determined by the inductance of the dimmer, the variable of the input capacitance C and the voltage UL across the inductance of the dimmer. The high peak values of the voltage UL across the inductance in the phase gating dimmer, the voltage UC across the input capacitance C and the system current IN are taken into consideration.

The reactive current, which is superimposed on the active current required for supplying the discharge lamp, is intended to be reduced. This reactive current is caused by the magnetization and demagnetization of the inductance in the phase gating dimmer, charges the input capacitance C further during the demagnetization T2 of the inductance in the dimmer and causes the voltage overshoot.

The current IN through the inductance of the phase gating dimmer increases as long as the voltage UC across the input capacitance C is lower than the supply voltage UIN. This is the case in the interval T1. Prior to the end of the phase gating (prior to the interval T1), the input capacitance C is charged in such a way that the voltage UC across the input capacitance C comes close to the instantaneous value of the supply voltage UIN at the end of the phase gating. Since UL=UIN−UC, the voltage UL across the inductance of the dimmer is then less at the beginning of the magnetization of this inductance than without any suitable charging of the input capacitance C. As a result, the peak current IN through the inductance of the dimmer is also comparatively low. Ideally, the voltage UC at the end of the phase gating corresponds to the instantaneous value of the supply voltage UIN. It will be shown further below that it is technically sensible, however, to select the value of the voltage UC to be slightly lower.

In this example, the instantaneous value of the supply voltage is stored in each system half-cycle of the supply system at the end of the phase gating; in the case of a time for the storage which is selected in a targeted manner, the stored value corresponds to the instantaneous value of the supply voltage UIN at the end of the phase gating. A corresponding circuit will be described further below. The input capacitance C is then, prior to the switching element in the dimmer being switched on again, charged in the next half-cycle to just short (90%) of the value stored in the preceding system half-cycle. It can be assumed here that the change in the phase gating of the dimmer performed by an operator in successive system half-cycles is only slight.

Figure 8A:
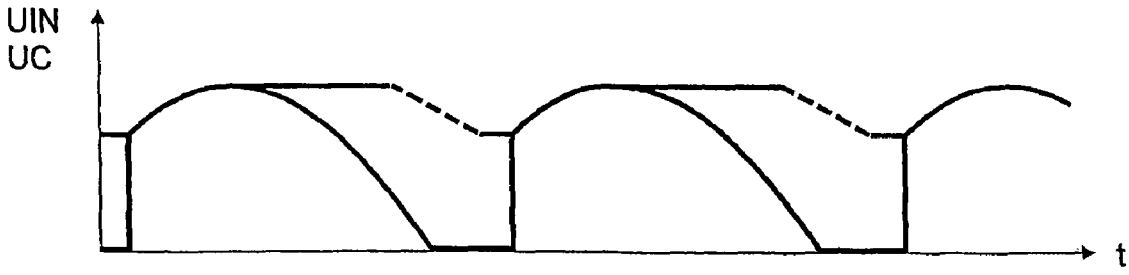
FIGS. 8*a, b* show, schematically, a profile of the voltage UC across the input capacitance C during discharging or charging of the input capacitance C and the supply voltage UIN.

FIGS. 8*a* and *b* show, schematically, the profile of the voltage UC during discharging or charging of the input capacitance C to the value of the supply voltage UIN stored in the preceding half-cycle. At the times at which the input capacitance C is charged or discharged, the profile of the voltage UC is illustrated by dashed lines because the precise profile is irrelevant.

Figure 8B:
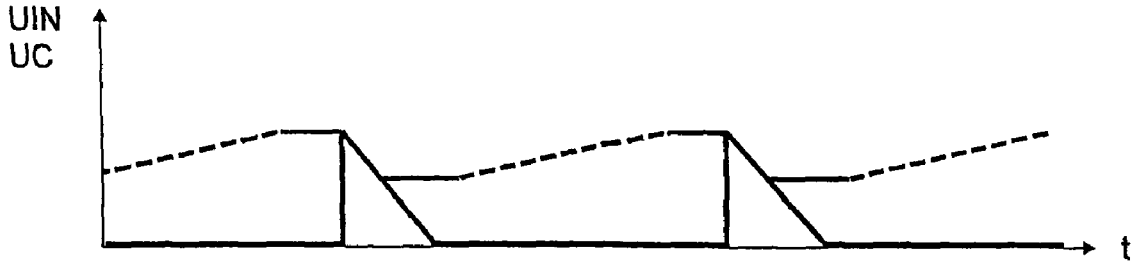

FIG. 8*a* shows the case in which the input capacitance C is discharged prior to the end of the phase gating, and FIG. 8*b* shows the case in which the input capacitance C is charged prior to the switching element in the dimmer being switched on. How this takes place will be described further below.

In both cases, the difference between the voltage UC across the input capacitance C and the instantaneous value of the supply voltage UIN at the end of the phase gating is therefore low or almost vanishes.

When the supply voltage UIN is first applied across the dimmer and to the load, a reactive current oscillation can possibly not be avoided because as yet no prognosis value for the supply voltage UIN has been stored. After a few system half-cycles, however, the system has reached a stable state.

Figure 9:
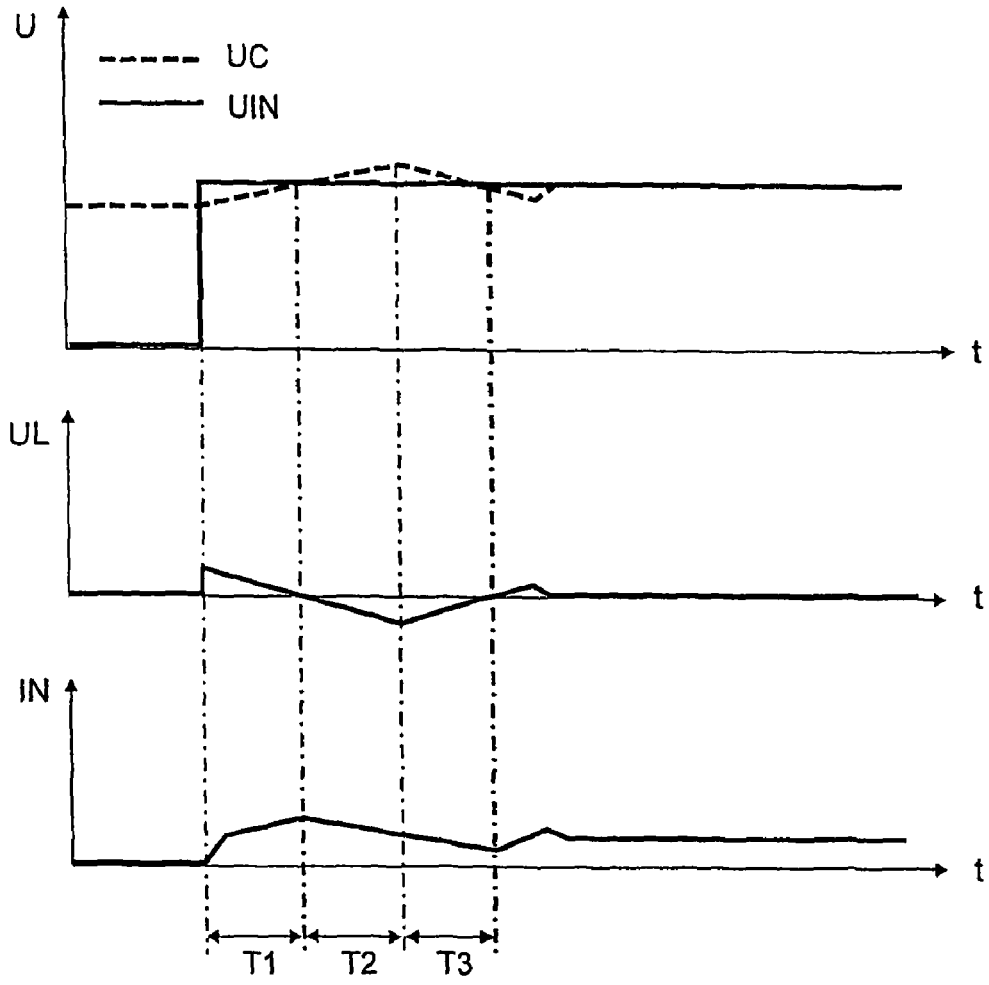
FIG. 9 shows, schematically, for an electronic ballast with a second device for reactive current oscillation reduction, the supply voltage UIN, the voltage UC across the input capacitance C of the load, the voltage UL across the inductance of the dimmer and the system current IN. Again, three relevant time intervals T1, T2, T3 are plotted.

FIG. 9 shows, for the further features of the exemplary embodiments, the supply voltage UIN, the voltage UC across the input capacitance C, the system current IN and the voltage UL across the inductance of the dimmer. For better understanding, only the effect of suitable charging of the input capacitance prior to the end of the phase gating is illustrated. Measures which have been explained with reference to FIGS. 3 to 6 are left out.

The voltage UC across the input capacitance C is slightly lower at the end of the phase gating than the value of the instantaneous voltage UIN. It can be seen that the peak value of the system current IN is markedly lower than that in FIG. 7. The peak value of the voltage UL present across the inductance is likewise lower. The system current IN oscillates considerably less. After the demagnetization T3 of the inductance in the dimmer, a continuous system current IN flows, which is different from that shown in FIG. 7. The invention prevents the holding current of the switching element in the dimmer being undershot.

FIG. 9 shows that the voltage UC across the input capacitance C is set to a value at the end of the phase gating which is below the corresponding instantaneous value of the supply voltage. This can ensure that in any case a current can flow to the load after the phase gating.

A further possibility of predicting the instantaneous value of the supply voltage UIN functions as follows: a further component part, for example an inductance, can be connected in series with the input of the electronic ballast. At the end of the phase gating, a voltage which is proportional to the difference UIN−UC drops across this component part, which voltage can then be used in a subsequent system half-cycle for setting the voltage across the input capacitance.

Figure 10A:
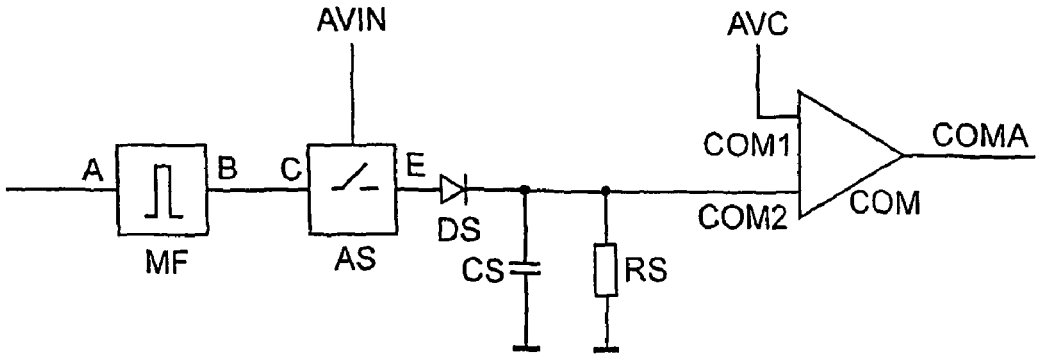
FIG. 10*a* shows a circuit arrangement for storing prognosis values and for comparing a prognosis value with the voltage UC across the input capacitance C.

FIG. 10*a* describes a more cost-effective and reliable circuit arrangement. The circuit has the object of measuring the instantaneous value of the voltage UIN after the phase gating. Furthermore, the circuit is intended to address a control device of the step-up converter for the described charging of the input capacitance C.

The circuit contains a monoflop MF, which is activated via a signal input A at the end of the phase gating. One of two states is present at an output B of the monoflop MF. One of these states indicates that the monoflop MF is set, and the other state is assumed by the monoflop MF in the remaining time.

The output B of the monoflop MF is connected to a control input C of a switch AS. The switch AS passes a signal AVIN on from a second input D to an output E if it is activated via the control input C. The signal AVIN is proportional to the input voltage UIN of the load.

A diode DS and a capacitor CS for peak value detection are connected at the output E of the switch AS. In this case, a resistor RS is connected in parallel with the capacitor CS. Via said resistor, the capacitor CS can be discharged slowly if the peak values to be detected become smaller. The discharge time of the capacitor CS is only determined by the size of the capacitance CS and the resistor RS. The corresponding time scale is selected such that it is suitable for the change in the phase gating by an operator.

The voltage across the capacitor CS is supplied to a first input COM2 of a comparator COM. A signal AVC, which is proportional to the voltage UC, is supplied to a second input COM1 of the comparator COM. An output COMA of the comparator assumes a first state if the signal AVC at the input COM1 is smaller than the signal at the other input COM2, and a second state if the signal at COM1 is greater than the signal at COM2. The output COMA of the comparator COM can be connected, for example, to the control device of the step-up converter.

The length of the time window in which the monoflop MF is set is very small in comparison with the period duration of the supply voltage UIN. In the longest case, the monoflop MF remains set during the entire magnetization of the inductance in the dimmer (in the interval T1).

Figure 10B:
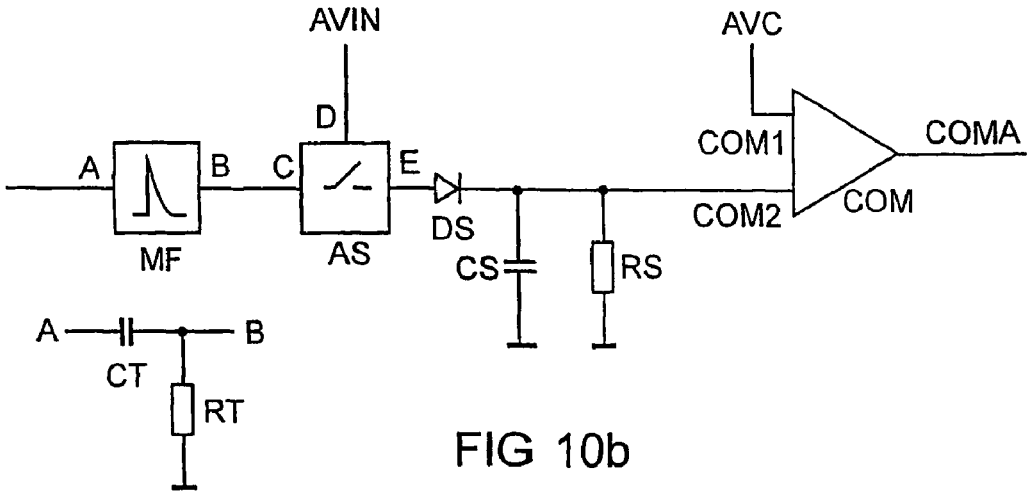
FIG. 10*b* shows a variant of the circuit arrangement shown in FIG. 10*a*.

FIG. 10*b* shows how the length of the time window can also be predetermined by means of a differentiator comprising a capacitor CT and a resistor RT. As is the case for the monoflop MF, the differentiator is addressed via a signal input at the end of the phase gating. A voltage jump therefore occurs across the resistor RT which decays exponentially. The time constant of the exponential decay is the product of the size of the resistor RT and the capacitor CT. The duration of the decay of the voltage jump across the resistor RT predetermines the time window in which the switch AS remains switched on.

Alternatively, a suitable time window for storing a prognosis value for the supply voltage UIN can also be detected by means of one of the circuit arrangements shown in FIGS. 4 and 6. The time of the end of the magnetization T1 of the inductance in the dimmer corresponds to the zero crossing of the second derivative of the voltage UC across the input capacitance C. This time is indicated by the signal outputs STA1 and STA2 and determines the end of the time window. In this case, the peak voltage UC across the input capacitance C up to this time can be stored as the prognosis value. Since the supply voltage has barely changed since the end of the phase gating, at this time the voltage UC across the input capacitance C corresponds to the instantaneous value of the supply voltage UIN at the end of the phase gating.

The circuit arrangements shown in FIGS. 10*a* and 10*b* can easily be incorporated in the step-up converter described in EP 1 465 330 A2, the US equivalent of which has been incorporated herein by reference as granted U.S. Pat. No. 7,132,802, as can the circuits from FIGS. 4 and 6. This step-up converter has a control circuit BCC, which, inter alia, can be driven by the circuit arrangement from FIGS. 10*a* and *b*. Furthermore, measures for charging or discharging the input capacitance C can be described specifically for this step-up converter.

The time at which the switching element in the dimmer is switched on can be detected in the step-up converter from EP 1 465 330 A2 by the beginning current flow through, for example, the storage inductor LH (L1 in EP 1 465 330 A2) of the step-up converter. This beginning current flow triggers the monoflop MF via the input A. At the end of the phase gating up to the end of a predeterminable time interval (the time window) the monoflop MF switches the switch AS on via the input C. While the switch AS is switched on, the capacitance CS across the diode DS detects the peak voltage present at the input AVIN.

The step-up converter from EP 1 465 330 A2 can be activated by the signal COMA for as long as the voltage UC across the input capacitance C is greater than the stored value. As a result, the input capacitance C is discharged to a value which is slightly below the value of the supply voltage UIN at the end of the phase gating. Specifically, the signal line COMA is linked to an element of the control circuit BCC of the step-up converter for this purpose. FIG. 5*a* of EP 1 465 330 A2 describes a flip-flop FF2, which can be set by means of the output COMA of the comparator COM in such a way that the step-up converter is activated.

Alternatively, the input capacitance C can also be discharged by a parallel-connected switching element, for example a series circuit comprising a transistor and a resistor. This switching element is driven via the signal line COMA in such a way that it is switched on and discharges the input capacitance C.

Figure 11:
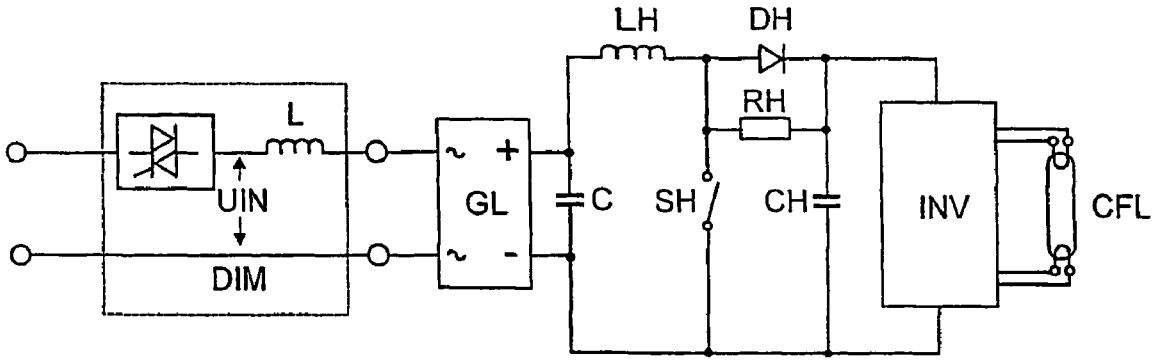
FIG. 11 shows a variant of the step-up converter circuit shown in FIG. 1 with a phase gating dimmer connected upstream.

FIG. 11 shows a variant of the step-up converter circuit with a phase gating dimmer connected upstream shown in FIG. 1; an additional resistor RH is connected in parallel with the diode DH.

If charging of the input capacitance C is desired, as shown in FIG. 8*b*, the diode DH can be bridged by a resistor RH. As a result, the input capacitance C can be charged via the intermediate circuit capacitor prior to the end of the phase gating. In order to charge the input capacitance to the value stored in the storage device, a controller is required. If it is desired not to include such a controller specifically, the input capacitance C can first be charged by the intermediate circuit capacitor to such an extent that the voltage UC across the input capacitance C is too high. Thereupon, the step-up converter can be activated in order to discharge the input capacitance C to the desired value.

There are designs of step-up converters which have a plurality of diodes connected between the supply potential of the intermediate circuit capacitor CH and the supply potential of the input capacitance C; in this case one or more diodes can be bridged.

The invention claimed is:

1. An electronic ballast with a step-up converter (LH, SH, DH, CH), which has an input capacitance (C), for operation using a phase gating dimmer, which has an inductance acting in series with a supply, characterized in that the electronic ballast has a device (DS, CS) for storing a prognosis value of a supply voltage (UIN) of the electronic ballast, in which, during a system half-cycle of the supply, the prognosis value of the supply voltage (UIN) is stored after termination of the phase gating in order to set the input capacitance (C), prior to the end of the phase gating, at most to a voltage which corresponds to the value stored in the device (DS, CS), by a charging operation in a subsequent system half-cycle.

2. The electronic ballast as claimed in claim 1, in which the storage device (DS, CS) is designed to store an instantaneous value of the supply voltage (UIN) during a system half-cycle after termination of the phase gating, the stored value corresponding to the prognosis value.

3. The electronic ballast as claimed in claim 2, in which the storage device (DS, CS) is designed to store the prognosis value of the supply voltage (UIN) after termination of the phase gating in each system half-cycle, and the ballast is designed to adjust the input capacitance (C), prior to the end of the phase gating, at most to a voltage which corresponds to the value stored in the device (DS, CS), in each respectively following system half-cycle.

4. The electronic ballast as claimed in claim 1, in which the storage device (DS, CS) is designed to store the prognosis value of the supply voltage (UIN) after termination of the phase gating in each system half-cycle, and the ballast is designed to adjust the input capacitance (C), prior to the end of the phase gating, at most to a voltage which corresponds to the value stored in the device (DS, CS), in each respectively following system half-cycle.

5. The electronic ballast as claimed in claim 1 which is designed to store the prognosis value to be stored of the supply voltage (UIN) within a time window after termination of the phase gating via a peak value detection (DS, CS).

6. The electronic ballast as claimed in claim 5, which has a monoflop (MF), which determines the duration of the time window.

7. The electronic ballast as claimed in claim 5, which has a differentiator (CT, RT) comprising a capacitor (CT) and a resistor (RT), the differentiator (CT, RT) having an exponentially decaying voltage drop across the resistor (RT) at the end of the phase gating, which voltage drop defines the time window.

8. The electronic ballast as claimed in claim 5, in which the time window for storing a prognosis value of the supply voltage (UIN) at the end of the phase gating closes with the end of the magnetization (T1) and, as a prognosis value, the peak voltage (UC) across the input capacitance (C) is stored.

9. The electronic ballast as claimed in claim 1, which is designed in such a way that a time window for storing the prognosis value of the supply voltage (UIN) opens and closes within a first time interval (T1) between the beginning of the magnetization of the inductance in the phase gating dimmer and the time of reaching an instantaneous value of a voltage (UC) across the input capacitance (C) of an instantaneous value of the supply voltage (UIN).

10. The electronic ballast as claimed in claim 9, which has a monoflop (MF), which determines the duration of the time window.

11. The electronic ballast as claimed in claim 9, which has a differentiator (CT, RT) comprising a capacitor (CT) and a resistor (RT), the differentiator (CT, RT) having an exponentially decaying voltage drop across the resistor (RT) at the end of the phase gating, which voltage drop defines the time window.

12. The electronic ballast as claimed in claim 9, in which the time window for storing a prognosis value of the supply voltage (UIN) at the end of the phase gating closes with the end of the magnetization (T1) and, as a prognosis value, the peak voltage (UC) across the input capacitance (C) is stored.

13. The electronic ballast as claimed in claim 1, which has a comparison device (COM), which compares the value stored in the storage device (DS, CS) with a present value of the voltage (UC) across the input capacitance (C) and whose output (COMA) influences the operation of the step-up converter.

14. The electronic ballast as claimed in claim 1, in which at least one diode (DH), which is connected between the supply potential-side terminals of an intermediate circuit capacitor (CH) of the step-up converter and the input capacitance (C), is bridged by a resistor (RH) so that the intermediate circuit capacitor (CH) can charge the input capacitance (C) prior to the end of the phase gating.

15. The electronic ballast as claimed in claim 1, in which the step-up converter is activated so as to discharge the input capacitance (C) prior to the end of the phase gating.

16. The electronic ballast as claimed in claim 1, which is designed to adjust, within a system half-cycle, operational parameters of the step-up converter (LH, SH, DH, CH) during a demagnetization (T2) of the inductance in the phase gating dimmer, temporally after the termination of the phase gating, in such a way that, in comparison with the operation of the step-up converter (LH, SH, DH, CH) after the demagnetization (T2) of the inductance, a temporarily increased current (ILH) flows through the step-up converter.

17. The electronic ballast as claimed in claim 16, in which the step-up converter (LH, SH, DH, CH) has a continuous and a discontinuous operating mode and, during the demagnetization (T2) of the inductance, temporally after the termination of the phase gating, functions in the continuous operating mode for temporarily increasing the current (ILH) through the step-up converter (LH, SH, DH, CH), and, after the demagnetization (T2), then functions in the discontinuous mode for the rest of the system half-cycle, however.

18. The electronic ballast as claimed in claim 16, in which, during the magnetization (T1) of the inductance in the phase gating dimmer, temporally after the termination of the phase gating, the switching element (SH) in the step-up converter (LH, SH, DH, CH) is off.

19. A discharge lamp with an integrated electronic ballast as claimed in claim 1.

20. A method for operating an electronic ballast with a step-up converter, which has an input capacitance (C), and a storage device (DS, CS) using a phase gating dimmer, which has an inductance acting in series with a supply, comprising storing a prognosis value of a supply voltage (UIN) of the electronic ballast, in which, during a system half-cycle of the supply, the prognosis value of the supply voltage (UIN) is stored after termination of the phase gating in order to charge the input capacitance (C), during the phase gating, at most to a voltage which corresponds to the value stored in the device (DS, CS), by a charging operation in a subsequent system half-cycle.

* * * * *

UNITED STATES PATENT AND TRADEMARK OFFICE

CERTIFICATE OF CORRECTION

PATENT NO. : 7,750,583 B2
APPLICATION NO. : 11/919009
DATED : July 6, 2010
INVENTOR(S) : Klaus Fischer and Josef Kreittmayr It is certified that error appears in the above-identified patent and that said Letters Patent is hereby corrected as shown below:

Column 15, line 42, delete "claim 2" and insert in place thereof --claim 1--

Signed and Sealed this

Twenty-sixth Day of October, 2010

David J. Kappos

David J. Kappos
*Director of the United States Patent and Trademark Office*